US005337527A

United States Patent [19]

Wagenaar

[11] Patent Number: 5,337,527

[45] Date of Patent: Aug. 16, 1994

[54] BUILDING BLOCK

[76] Inventor: Jack Wagenaar, Pole Line Road, R.R. #5, Thunder Bay, Ontario, Canada, P7C 5M9

[21] Appl. No.: 15,101

[22] Filed: Feb. 9, 1993

[51] Int. Cl.[5] ..... E02D 5/00; E04C 1/00

[52] U.S. Cl. ..... 52/169.2; 52/169.1; 52/604; 405/284

[58] Field of Search ..... 52/561, 575, 593, 604, 52/605, 169.1, 169.2, 169.3, 169.4, 589, 590, 603, 606, 608, 609, 610, 611; 405/284, 285, 286

[56] References Cited

U.S. PATENT DOCUMENTS

| | | | |
|---|---|---|---|
| 868,838 | 10/1907 | Brewington . | |
| 894,122 | 7/1908 | Dougherty . | |
| 1,971,915 | 8/1934 | Mekler . | |
| 2,141,035 | 12/1938 | Daniels | 52/604 |
| 2,201,110 | 5/1940 | Makram | 52/575 |
| 2,688,245 | 9/1954 | Vesper . | |
| 3,116,570 | 1/1964 | Torricelli . | |
| 3,269,070 | 8/1966 | Stoy | 52/575 |
| 3,305,982 | 2/1967 | Steele . | |
| 3,464,211 | 9/1969 | Andresen . | |
| 3,643,392 | 2/1972 | Martinez . | |
| 4,067,166 | 1/1978 | Sheahan . | |
| 4,815,897 | 3/1989 | Risi et al. . | |
| 4,875,803 | 10/1989 | Scales . | |
| 4,896,999 | 1/1990 | Ruckstuhl . | |
| 5,003,746 | 4/1991 | Wilston . | |
| 5,044,834 | 7/1991 | Janopaul, Jr. . | |
| 5,154,032 | 10/1992 | Ritter | 52/593 |

*Primary Examiner*—Michael Safavi
*Attorney, Agent, or Firm*—Rogers & Scott

[57] ABSTRACT

A building block for dry wall construction has a body with front and rear faces, opposite end faces and top and bottom faces. One end face has a laterally projecting vertically extending rib with an arcuate outer surface, and the other end face has an arcuate recess to receive the rib of a laterally adjacent like vertically extending block in a manner permitting limited relative swivelling movement of two blocks about a vertical axis. One of the top and bottom faces has at least one projection, and the other of the top and bottom faces has a laterally extending groove to receive the at least one projection of a vertically adjacent like block in a manner to permit relative lateral adjustment of vertically adjacent blocks and prevent relative forward or rearward movement thereof.

9 Claims, 2 Drawing Sheets

BUILDING BLOCK

Figure 1:
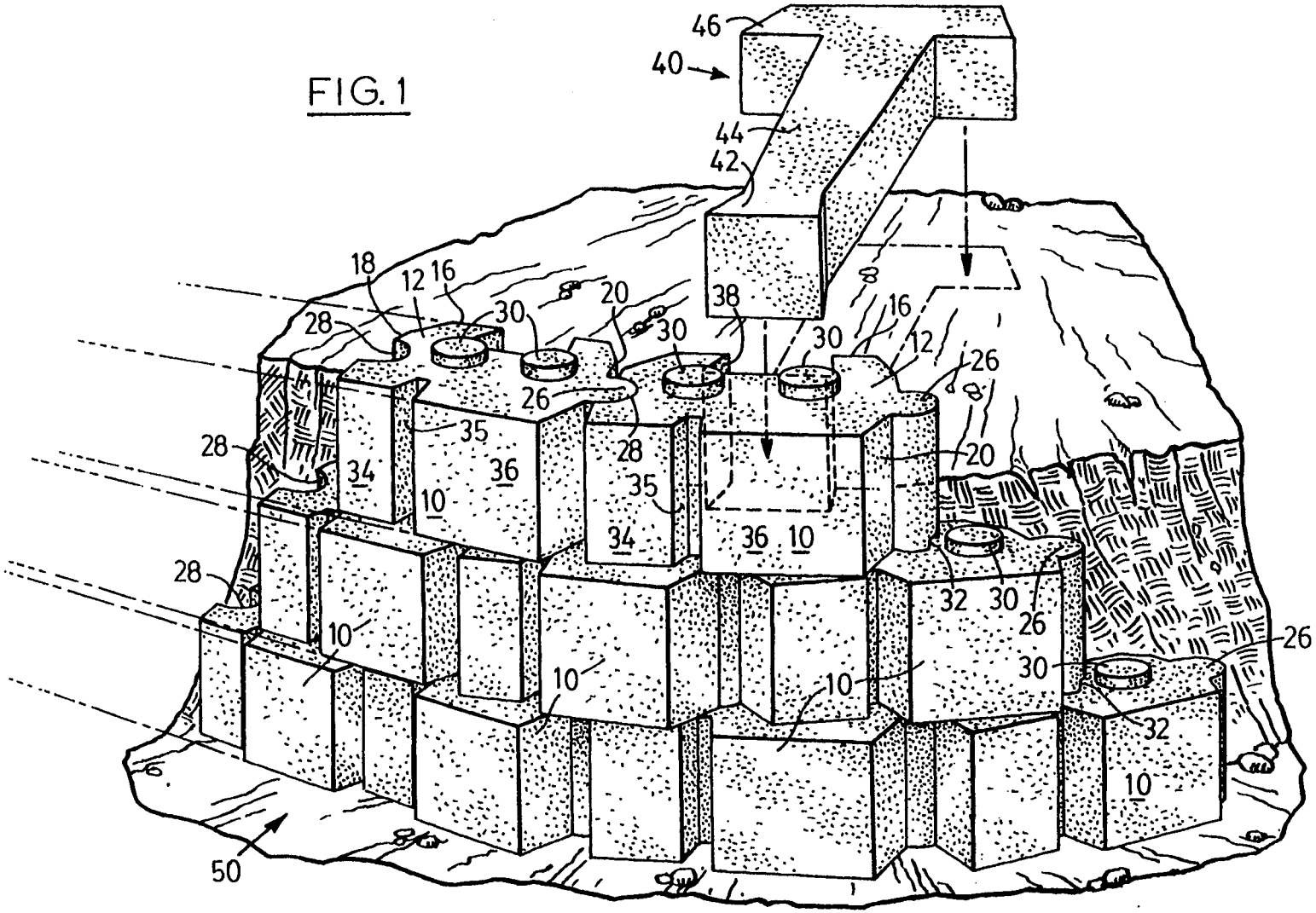

This invention relates to building blocks for drywall construction.

Various building blocks for construction of drywalls have previously been proposed, but there is still a need for a building block which enables a drywall to be built which is attractive in appearance, relatively inexpensive, easy to construct, long lasting, and capable of extending laterally in a straight path or in a curved path.

It is therefore an object of the invention to provide a building block meeting such requirements.

According to the invention, a building block for drywall construction comprises a body having front and rear faces, opposite end faces and top and bottom faces, one end face having a laterally projecting vertically extending rib with an arcuate outer surface, the other end face having an arcuate recess to receive the rib of a laterally adjacent-like vertically extending block in a manner permitting limited relative swivelling movement of two blocks about a vertical axis, one of the top and bottom faces having at least one projection, and the other of the top and bottom faces having a laterally extending groove to receive the at least one projection of a vertically adjacent-like block in a manner to permit relative lateral adjustment of vertically adjacent blocks and prevent relative forward or rearward movement thereof.

In a drywall constructed from such building blocks, each pair of laterally adjacent blocks is connected by engagement of the vertically extending rib of one block in the vertically extending arcuate recess in the adjacent block in a manner permitting limited relative swivelling movement of the two blocks about a vertical axis, and vertically adjacent blocks are connected by engagement of the at least one projection in one block in the laterally extending groove in the other block in a manner to permit relative lateral adjustment of the blocks and prevent relative forward or rear movement thereof.

The groove in each block may extend along the whole length of the block from one end face to the other end face. The rib of each block may extend to the groove and the recess in each block may intersect the groove.

The at least one projection may be further from one of the front and rear faces then the groove to cause vertically adjacent blocks to be staggered in a forward or rear sense. The at least one projection may comprise two laterally spaced projections each with a circular periphery.

The front face may have a first portion adjacent one end of the block which is rearwardly staggered with respect to a second front face portion adjacent to the opposite end of the block.

The rear face may have a re-entrant groove extending to at least one of the top and bottom faces to receive a complementarily-shaped anchor member.

The anchor member may have a head portion with a complementary shape to the re-entrant groove and slidably mounted therein and a retaining portion extending from a head portion rearwardly from the block for retention in earth behind the wall.

Figures 2, 3, 4:
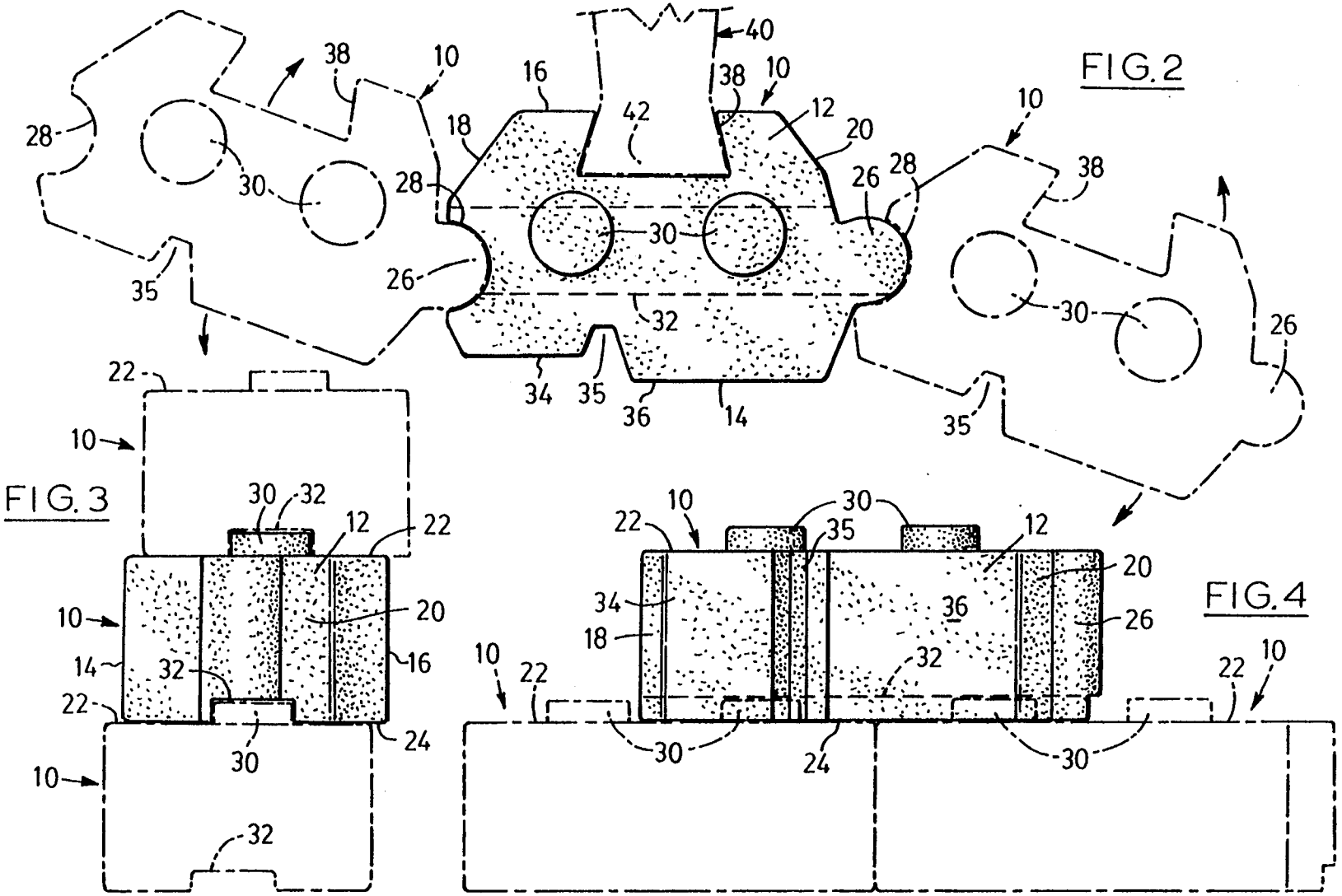

Embodiments of the invention will now be described, by way of example, with reference to the accompanying drawings, in which:

FIG. 1 is a perspective view of a drywall construction using building blocks in accordance with one embodiment of the invention, FIG. 2 is a plan view showing how laterally adjacent blocks in a row may be relatively oriented to form a desired curved path, FIG. 3 is a side view showing how vertically adjacent blocks are staggered in the vertical sense, and FIG. 4 is a front view showing how blocks in one row can be laterally adjusted with respect to blocks in a lower row.

Referring to the drawings, a building block 10 is formed as a casting of suitable concrete and has a body 12 with front and rear faces 14, 16, opposite end faces is 18, 20 and top and bottom faces 22, 24. The end face 20 has a laterally projecting vertically extending rib 26 with an arcuate surface extending from top to bottom of the block 10, and the other end face 18 has a vertically extending arcuate recess 28 likewise extending from top to bottom of the block 10.

The top face 22 has two laterally spaced projections 30 with circular peripheries, and the bottom face 24 has a laterally extending groove 32 extending along the whole length of the block 10 with the rib 26 extending to the groove 32 and the recess 28 intersecting the groove 32. The projections 30 are further from the front face 14 than the groove 32.

The front face 14 has a first portion 34 adjacent one end of the block 10 which is rearwardly staggered with respect to a second front face portion 36 adjacent the opposite end of the block 10. A vertically extending V-shaped groove 35 appears between the two front face portions 34, 36. The rear face 16 has a re-entrant groove 38 extending from top to bottom to receive the complementarily shaped head portion 42 of an anchor member 40. The anchor member 40 also has a shank portion 44 extending rearwardly from the head portion 42 to an anchor portion 46 at the rear end of the shank portion 44.

The manner in which the blocks 10 can be used to form a retaining wall for earth 50 is shown in FIG. 1. In each row, adjacent blocks 10 are positioned so that the vertically extending rib 26 of one block 10 is located in the vertically extending recess 28 in the adjacent block 10. FIG. 1 shows a wall which is continuously curved in the same lateral sense. FIG. 2 shows how the blocks 10 can be swivelled relative to one another to form other laterally extending curved paths. The blocks 10 could of course be oriented so as to extend laterally in a straight path if desired.

Since the projections 30 are further from the front face 14 than the groove 32, the blocks 10 in one row are rearwardly staggered relative to the blocks 10 in the lower row, as shown in FIG. 3. Also, since the lateral extending groove 32 in the bottom of each block 10 receives two projections 30 of a block or blocks 10 in a lower row and since the groove 32 extends for the whole width of a block 10, the blocks 10 in one row can be laterally staggered with respect to the blocks 10 in a lower row in a desired manner, as indicated in FIG. 4.

It will therefore be readily apparent that a building block in accordance with the present invention enables drywalls to be constructed with various different configurations. Blocks with different designs of front faces 14 may of course be utilized if desired.

If necessary, an appropriate number of anchor members 40 may be used to retain the wall in place. The head portion 42 of each anchor member 42 is dropped vertically into the groove 38 in the rear face 16 of a block 10 and the shank portion 44 on anchor portion 46 of the anchor member 40 are embedded in the earth 10.

Other embodiments of the invention will be readily apparent to a person skilled in the art, the scope of the invention being defined in the appended claims.

What I claim is:

1. A drywall construction comprising vertically superposed rows of laterally adjacent building blocks, each block comprising a body having front and rear faces, opposite end faces and top and bottom faces, one end face having a laterally projecting vertically extending rib with an arcuate outer surface, the other end face having an arcuate recess to receive the rib of a laterally adjacent like vertically extending block in a manner permitting limited relative swivelling movement of two blocks about a vertical axis, one of the top and bottom faces having at least one projection, the other of the top and bottom faces having a laterally extending groove to receive the at least one projection of a vertically adjacent like block in a manner to permit relative lateral adjustment of vertically adjacent blocks and prevent relative forward or rearward movement thereof, and the at least one projection being further from one of the front and rear faces than the groove to cause vertically adjacent blocks to be staggered in an upward and rearward sense, each pair of laterally adjacent blocks being connected by engagement of the vertically extending rib of one block in the vertically extending arcuate recess in the adjacent block in a manner permitting limited relative swivelling movement of the two blocks about a vertical axis, and vertically adjacent blocks being connected by engagement of the at least one projection in one block in the laterally extending groove in a vertically adjacent block in a manner to permit relative lateral adjustment of the blocks and prevent relative forward or rear movement thereof, and the at least one projection of each block being further from one of the front and rear faces than the groove to cause vertically adjacent blocks to be staggered in an upward and rearward sense.

2. A drywall construction according to claim 1 wherein said groove in each block extends along the whole length of the block from one end face to the other end face.

3. A drywall construction according to claim 2 wherein the rib of each block extends to the groove and the recess intersects the groove.

4. A drywall construction according to claim 1 wherein the at least one projection of each block comprises two laterally spaced projections each with a circular periphery.

5. A drywall construction according to claim 1 wherein the front face of each block has a first portion adjacent one end of the block which is rearwardly staggered with respect to a second front face portion adjacent to the opposite end of the block.

6. A drywall construction according to claim 1 wherein the rear face of each block has a re-entrant groove extending to at least one of the top and bottom faces, the construction also comprising at least one anchor member, the anchor member having a head portion with a complementary shape to the re-entrant groove in one of said building blocks and slidably mounted and retained therein and a retaining porting extending from the head portion rearwardly from said one building block for retention in earth behind the wall.

7. A building block for dry wall construction comprising a body having front and rear faces, opposite end faces and top and bottom faces, one end face having a laterally projecting vertically extending rib with an arcuate outer surface, the other end face having an arcuate recess to receive the rib of a laterally adjacent like vertically extending block in a manner permitting limited relative swivelling movement of two blocks about a vertical axis, one of the top and bottom faces having at least one projection, the other of the top and bottom faces having a laterally extending groove to receive the at least one projection of a vertically adjacent like block in a manner to permit relative lateral adjustment of vertically adjacent blocks and prevent relative forward or rearward movement thereof, and the at least one projection being further from one of the front and rear faces than the groove to cause vertically adjacent blocks to be staggered in an upward and rearward sense, the at least one projection comprising two laterally spaced projections each with a circular periphery.

8. A building block for dry wall construction comprising a body having front and rear faces, opposite end faces and top and bottom faces, one end face having a laterally projecting vertically extending rib with an arcuate outer surface, the other end face having an arcuate recess to receive the rib of a laterally adjacent like vertically extending block in a manner permitting limited relative swivelling movement of two blocks about a vertical axis, one of the top and bottom faces having at least one projection, the other of the top and bottom faces having a laterally extending groove to receive the at least one projection of a vertically adjacent like block in a manner to permit relative lateral adjustment of vertically adjacent blocks and prevent relative forward or rearward movement thereof, and the at least one projection being further from one of the front and rear faces than the groove to cause vertically adjacent blocks to be staggered in an upward and rearward sense, the front face having a first portion adjacent one end of the block which is rearwardly staggered with respect to a second front face portion adjacent the opposite end of the block.

9. A building block for dry wall construction comprising a body having front and rear faces, opposite end faces and top and bottom faces, one end face having a laterally projecting vertically extending rib with an arcuate outer surface, the other end face having an arcuate recess to receive the rib of a laterally adjacent like vertically extending block in a manner permitting limited relative swivelling movement of two blocks about a vertical axis, one of the top and bottom faces having at least one projection, the other of the top and bottom faces having a laterally extending groove to receive the at least one projection of a vertically adjacent like block in a manner to permit relative lateral adjustment of vertically adjacent blocks and prevent relative forward or rearward movement thereof, and the at least one projection being further from one of the front and rear faces than the groove to cause vertically adjacent blocks to be staggered in an upward and rearward sense, the rear face having a re-entrant groove extending to at least one of the top and bottom faces shaped to receive and retain a complementarily-shaped anchor member.

* * * * *